US009895697B2

(12) United States Patent
Onuki et al.

(10) Patent No.: US 9,895,697 B2
(45) Date of Patent: Feb. 20, 2018

(54) MEDIA-AGITATION TYPE PULVERIZER

(71) Applicant: ASHIZAWA FINETECH LTD., Narashino-shi, Chiba (JP)

(72) Inventors: Jiro Onuki, Narashino (JP); Yoshinori Ueno, Narashino (JP); Hiroyuki Ito, Narashino (JP)

(73) Assignee: ASHIZAWA FINETECH LTD., Narashino-shi, Chiba (JP)

( * ) Notice: Subject to any disclaimer, the term of this patent is extended or adjusted under 35 U.S.C. 154(b) by 105 days.

(21) Appl. No.: 14/895,400

(22) PCT Filed: Dec. 19, 2013

(86) PCT No.: PCT/JP2013/084066
§ 371 (c)(1),
(2) Date: Dec. 2, 2015

(87) PCT Pub. No.: WO2014/196101
PCT Pub. Date: Dec. 11, 2014

(65) Prior Publication Data

US 2016/0114332 A1 Apr. 28, 2016

(30) Foreign Application Priority Data

Jun. 3, 2013 (JP) ..... 2013-116611

(51) Int. Cl.
*B02C 17/00* (2006.01)
*B02C 17/16* (2006.01)
*B02C 17/18* (2006.01)

(52) U.S. Cl.
CPC ..... *B02C 17/163* (2013.01); *B02C 17/16* (2013.01); *B02C 17/161* (2013.01); *B02C 17/184* (2013.01)

(58) Field of Classification Search
CPC ... B02C 17/163; B02C 17/161; B02C 17/184; B02C 17/16
(Continued)

(56) References Cited

U.S. PATENT DOCUMENTS 4,620,673 A 11/1986 Canepa et al.
5,791,569 A 8/1998 Ishikawa

FOREIGN PATENT DOCUMENTS

CN 1864857 A 11/2006
JP 2006-212488 A 8/2006
(Continued)

OTHER PUBLICATIONS

English Translation of Korean Office Action (Application No. 10-2015-7026694) (5 pages—Disptached date Jul. 29, 2016).
(Continued)

*Primary Examiner* — Faye Francis
(74) *Attorney, Agent, or Firm* — Renner, Kenner, Greive, Bobak, Taylor & Weber

(57) ABSTRACT

[Problem] To resolve segregation of grinding media to thereby enable a large-flow-rate circulation operation while reducing wear of an agitating member and a grinding media separating member. [Solution] In a media-agitation type pulverizer, the agitating means comprises: a circular plate-shaped hub member (26) fixed to an end of a rotary drive shaft located inside a grinding chamber, wherein the rotary drive shaft extends front the side of one end of the grinding chamber into the grinding chamber; an annular end plate (28) disposed in spaced-apart relation to the hub member in an axial direction of the rotary drive shaft; a plurality of agitating members (30) fixed between the hub member and the end plate at circumferential intervals, in a posture where each of them protrudes radially outwardly from respective outer peripheries of the hub member and the end plate; and
(Continued)

a plurality of grinding media scraping-out members (31) each extending radially inwardly with respect to the outer peripheries of the hub member and the end plate, wherein an open region as a part of an outer periphery of the agitating means other than thicknesses of the agitating members and the grinding media scraping-out members is formed as a grinding media circulation opening (22*a*) for circulating the grinding media from an inside to an outside of the agitating means, and wherein an area ratio of the grinding media circulation opening to a circumferential plane between opposing surfaces of the hub member and the end plate of the agitating means is set to 50 to 90%.

11 Claims, 3 Drawing Sheets

(58) Field of Classification Search
USPC ..... 241/171, 172
See application file for complete search history.

(56) References Cited

FOREIGN PATENT DOCUMENTS

| | | | |
|---|---|---|---|
| JP | 2006-346667 | A | 12/2006 |
| JP | 2007-83241 | A | 4/2007 |
| JP | 2010-5540 | A | 1/2010 |
| JP | 5046557 | B2 | 7/2012 |
| KR | 20-0154781 | Y1 | 8/1999 |

OTHER PUBLICATIONS

International Preliminary Report (PCT/JP2013/084066) (4 pages—dated Dec. 8, 2015).
Taiwanese Office Action (Application No. 103111114) (8 pages—dated Mar. 22, 2017).
Taiwanese Office Action—English Translation (Application No. 103111114) (6 pages—dated Mar. 22, 2017).

MEDIA-AGITATION TYPE PULVERIZER

TECHNICAL FIELD

The present invention relates to a media-agitation type pulverizer for use in wet pulverization of a powder. The media-agitation type pulverizer of the present invention is particularly suitable for use in, but not limited to, mixing a material, such as ink, paint, pigment, ceramics, metal, inorganic material, dielectric, ferrite, toner, glass or paper coating, with grinding media, to pulverize the material into fine particles.

BACKGROUND ART

Examples of a conventional media-agitation type pulverizer for use in wet pulverization include an agitator mill described in JP 2-10699B (Patent Document 1). The agitator mill described in the Patent Document 1 comprises: a milling body which includes a grinding chamber to be filled at least partly with grinding media and material to be ground and has an inlet for material to be ground and an outlet for crushed material, an agitator shaft having an inner shaft end inside the grinding chamber, and a separating means permitting finished pulverized material to flow out of the grinding chamber to the outlet yet retaining grinding media, wherein the agitator shaft has an end portion formed with a cavity therein which is open at the inner shaft end, the end portion of the agitator shaft includes recesses, distributed around the cavity and spaced from the inner shaft end, through which said grinding media from said grinding chamber may axially flow into the cavity and through the inner shaft end to flow back into the grinding chamber, and the separating means is arranged at least substantially inside the cavity.

In the agitator mill disclosed in the Patent Document 1, irrespective of what kind of special structure the separating device has, the separating device is disposed in the cavity formed in the end portion of the agitator shaft and opened at one end thereof so as to be protected. This provides an advantage that there is almost no opportunity for the grinding media to be brought into collision with the separating device due to the rotation of the agitator shaft. In addition, rotation of the agitator shaft can prevent an action of the separating device from being blocked, i.e., a risk of clogging of the separating device.

However, in this agitator mill, when a circulation flow rate of material slurry is increased, or when material slurry has high viscosity and high concentration, the grinding media are undesirably segregated in a region surrounding distal ends of agitating members (which are not agitator shaft) as an end region of a flow within the grinding chamber, and a region around a screen serving as the separating device, to cause a rise in internal pressure of the grinding chamber, resulting in preclusion of stable operation. Moreover, the segregation of the grinding media causes deterioration in flowability around an outer peripheral portion of the agitator shaft acting as the agitating members. This leads to a problem that a solid content of the material slurry fixedly adheres to recesses in the portion of the agitator shaft acting as the agitating members, or outer peripheries of the distal ends of the agitating members undergo uneven wear due to the segregated grinding media.

Therefore, in order to solve this problem, a pulverizer capable of coping with a large-flow-rate operation, as disclosed in JP 3663010B (Patent Document 2), has been developed. The pulverizer disclosed in the Patent Document 2 comprises: a grinding chamber formed in a hollow cylindrical shape having closed opposite ends; a hollow cylindrical separator provided within the grinding chamber in coaxial relation thereto to radially partition an internal space of the grinding chamber into two chambers consisting of an inner chamber and an outer chamber, wherein the separator has a plurality of slits each formed over the entire circumference thereof to provide fluid communication between the two chambers; an agitator unit provided inside the inner chamber rotatably in a coaxial relation to the grinding chamber, a material supply port providing fluid communication between an inside and an outside of the inner chamber and a material discharge port providing fluid communication between an inside and an outside of the outer chamber, wherein the agitating member is formed in a hollow cylindrical shape, and wherein the agitating member has a recess and a protrusion which are alternately provided on an outer peripheral surface thereof, and an opening provided in a hollow cylindrical portion of the agitating member to penetrate therethrough in a direction from an inside to an outside thereof, and wherein the pulverizer is configured to cause a material and grinding media to mutually flow between the inside and the outside of the agitating member via the opening. The pulverizer is also configured such that a ratio of an axial length (L) to a diameter (D) of the grinding chamber (ratio L/D) is 1.0 or less.

In the pulverizer disclosed in the Patent Document 2, the ratio L/D is set to 1.0 or less, so that it becomes possible to resolve segregation of the grinding media around distal ends of the agitating member. Further, a wall of the hollow cylindrical agitating member is provided with the opening penetrating therethrough in the direction from the inside to the outside thereof, and the screen configured to separate the material slurry from the grinding media is provided around the agitating member, so that it becomes possible to provide a structure capable of preventing a flow from the inside of the agitating member toward the screen from being hindered, i.e., to increase a flow rate without any pressure rise, thereby achieving stable operation.

However, in the pulverizer disclosed in the Patent Document 2, the flow from the inside of the agitating member toward the screen is directionally the same as an exit flow of the slurry separated from the grinding media. Thus, the grinding media are inevitably pressed against the screen, thereby causing a problem that a surface of the screen is significant worn away.

Therefore, JP 5046557B (Patent Document 3) proposes a media-agitation type wet dispenser configured to allow grinding media to easily flow inside an agitating member so as to solve the above problem. The media-agitation type wet disperser disclosed in the Patent Document 3 comprises: a cylindrical chamber; a hollow cylindrical separator which radially partitions an internal space of the chamber into an inner chamber and an outer chamber, and has a plurality of slits each providing fluid communication between the two chambers; a rotary shaft rotatably provided while penetrating through one end of the chamber, a rotor fixed to the rotary shaft and configured to be rotated; a material supply port provided at the other end of the chamber to provide fluid communication between an inside and an outside of the inner chamber; and a material discharge port provided at an outer periphery of the chamber to provide fluid communication between an inside and an outside of the outer chamber, wherein the rotor is composed of a plurality of small rotors each comprising a cylindrical agitating section and a disk-shaped holding section, and wherein the agitating section has a plurality of through-holes each providing fluid communication between an inside and an outside thereof. This structure provides improved flowability of grinding media. However, a flow from an inside of the agitating member toward the screen is directionally the same as an exit flow of the slurry separated from the grinding media. Thus, when a recirculation flow rate is increased, a force acting to return the grinding media toward the inside of the agitating member becomes failing to withstand the exit flow of the slurry, resulting in significant wear of the screen.

SUMMARY OF INVENTION

Technical Problem

It is an object of the present invention to provide a media-agitation type pulverizer capable of resolving segregation of grinding media which has been recognized as a problem in conventional media-agitation type pulverizers, to thereby enable a large-flow-rate circulation operation while reducing wear of an agitating member and a grinding media separating member.

Solution to Technical Problem

The above object can be achieved by a media-agitation type pulverizer of the present invention having the following features (1) to (13).

(1)

A media-agitation type pulverizer comprising: a cylindrical grinding chamber, a cylindrical agitating means disposed inside the grinding chamber rotatably in coaxial relation thereto; a grinding media separating means disposed inside the agitating means in coaxial relation thereto; a grinding space disposed between an outer periphery of the agitating means and an inner periphery of the grinding chamber; grinding media contained in the grinding space; a material supply passage for supplying a slurry material into the grinding chamber; and a material discharge passage for discharging a dispersed and/or pulverized material to an outside of the grinding chamber, wherein the agitating means comprises: a circular plate-shaped hub member fixed to an end of a rotary drive shaft located inside the grinding chamber, wherein the rotary drive shaft extends from the side of one end of the grinding chamber into the grinding chamber; an annular end plate disposed in spaced-apart relation to the hub member in an axial direction of the rotary drive shaft; a plurality of agitating members fixed between the hub member and the end plate at circumferential intervals, in a posture where each of them protrudes radially outwardly with respect to respective outer peripheries of the hub member and the end plate; and a plurality of grinding media scraping-out members for scraping out the grinding media residing inside the agitating means toward an outside of the agitating means, the grinding media scraping-out members being fixed between the hub member and the end plate at circumferential intervals, in a posture where each of them extends radially inwardly with respect to the outer peripheries of the hub member and the end plate, and wherein an open region as a part of an outer periphery of the agitating means other than thicknesses of the agitating members and the grinding media scraping-out members is formed as a grinding media circulation opening for circulating the grinding media from the inside to the outside of the agitating means, and wherein an open ratio as an area ratio of the grinding media circulation opening to a circumferential plane between opposing surfaces of the hub member and the end plate of the agitating means is 50 to 90%.

(2)

The media-agitation type pulverizer set forth in (1), wherein the open ratio of the grinding media circulation opening to the circumferential area between opposing surfaces of the hub member and the end plate of the agitating means is 70 to 90%.

(3)

The media-agitation type pulverizer set forth in (1) or (2), wherein a ratio of a radial length of an operating surface of each of the grinding media scraping-out members to a radial length of an operating surface of the agitating means is 3:7 to 7:3.

(4)

The media-agitation type pulverizer set forth in (3), wherein the ratio of the radial length of the operating surface of each of the grinding media scraping-out members to the radial length of the operating surface of the agitating means is 4:6 to 6:4.

(5)

The media-agitation type pulverizer set forth in any one of (1) to (4), wherein an angle defined between an operating surface of each of the grinding media scraping-out members and a radial axis of the agitating means is 0 to 45 degrees.

(6)

The media-agitation type pulverizer set forth in (5), wherein an angle defined between an operating surface of each of the grinding media scraping-out members and a radial axis of the agitating means is 10 to 40 degrees.

(7)

The media-agitation type pulverizer set forth in any one of (1) to (6), wherein each of a plurality of sets of the agitating member and the grinding media scraping-out member are integrated into a single piece.

(8)

The media-agitation type pulverizer set forth in any one of (1) to (7), wherein the grinding media separating means comprises a separating means body and a support member supporting the separating means body, and wherein the separating means body has an outer diameter which is 80% or more of a diameter of a circle connecting respective inner edges of the grinding media scraping-out members, and a gap between the diameter of the circle connecting the inner edges of the grinding media scraping-out members and the outer diameter of the separating means body is three times or more greater than a diameter of each of the grinding media.

(9)

The media-agitation type pulverizer set forth in (8), wherein the grinding media separating means is fixed to the side of the other end of the grinding chamber, and wherein the separating means body is inserted into an internal space of the agitating means from the side of the other end.

(10)

The media-agitation type pulverizer set forth in any one of (1) to (9), wherein the grinding media separating means is a screen type grinding media separating means.

(11)

The media-agitation type pulverizer set forth in (8) or (9), wherein the separating means body is completely received in an internal space of the agitating means.

(12)

The media-agitation type pulverizer set forth in (9) or (11), wherein the separating means body has an overall length which is 20 to 80% of an overall length of the internal space of the agitating means.

(13)

The media-agitation type pulverizer set forth in (8), wherein the support member has an outer diameter which is 50% or more of an inner diameter of the agitating means, and the gap between the inner diameter of the agitating means and the outer diameter of the support member is three times or more greater than the diameter of each of the grinding media, with respect to m inner diameter of the end plate of the agitating means.

Effect of Invention

In the media-agitation type pulverizer of the present invention having the above features, by an action of centrifugal force of the agitating means, a flow causing the grinding media and material slurry inside the agitating means to be led to the outside of the agitating means is formed. Further, the open ratio of the grinding media circulation opening of the agitating means is set to 50 to 90%, i.e., the grinding media circulation opening is widely opened in a the circumferential plane of the agitating means, so that it becomes possible to prevent the occurrence of adhering of a solid content to an inside of the agitating means, and adequately regulate a flow of the grinding media toward the inside and outside of the agitating means without hindering the flow, even when the slurry material has high viscosity and high concentration.

In the media-agitation type pulverizer of the present invention, the outer diameter of the separating means body may be set to 80% or more of the diameter of the circle connecting the inner edges of the grinding media scraping-out members 31, and the gap between the diameter of the circle connecting the inner edges of the grinding media scraping-out members and the outer diameter of the separating means body may be set to be three times or more greater than the diameter of each of the grinding media, i.e., each of the grinding media scraping-out members and the separating means body may be arranged in adjacent relation. This makes it possible to allow the grinding media residing around an outer periphery of the separating means body to easily flow outside the agitating means, thereby reducing segregation of the grinding media around the separating means body and wear due to the grinding media.

Further, in the media-agitation type pulverizer of the present invention, the outer diameter of the support member of the grinding media separating means may be set to 50% or more of the inner diameter of the annular end plate of the agitating means, and the gap between the inner diameter of the annular end plate of the agitating means and the outer diameter of the support member may be set to be three times or more greater than the diameter of each of the grinding media. In this case, it becomes possible to prevent hindering of a flow of a mixture of the grinding media and the material slurry toward an internal space of the agitating means, and reduce segregation of the grinding media around one open end of the agitating means and uneven wear due to the grinding media. This makes it possible to perform a stable operation without any increase in internal pressure of the grinding chamber to thereby enable a large-flow-rate circulation operation.

DESCRIPTION OF EMBODIMENTS

Figure 1:
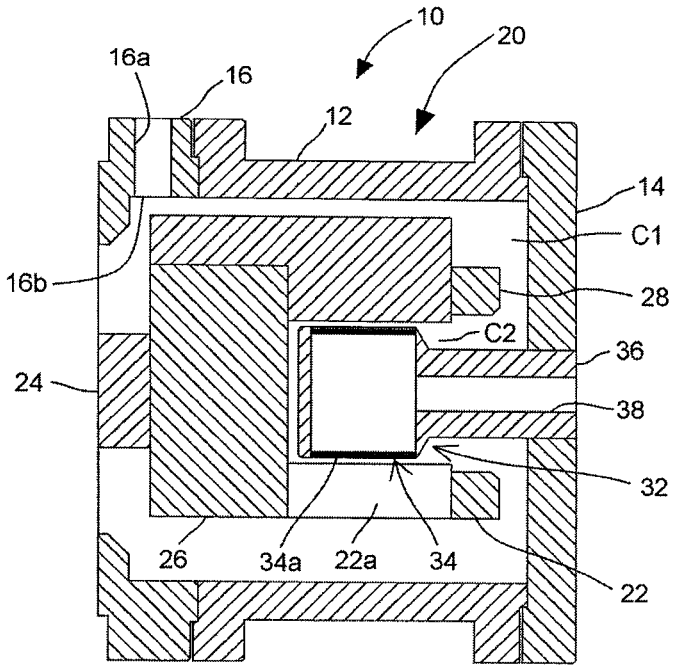
FIG. 1 is a longitudinal sectional view of a media-agitation type pulverizer according to one embodiment of the present invention.
Figure 2:
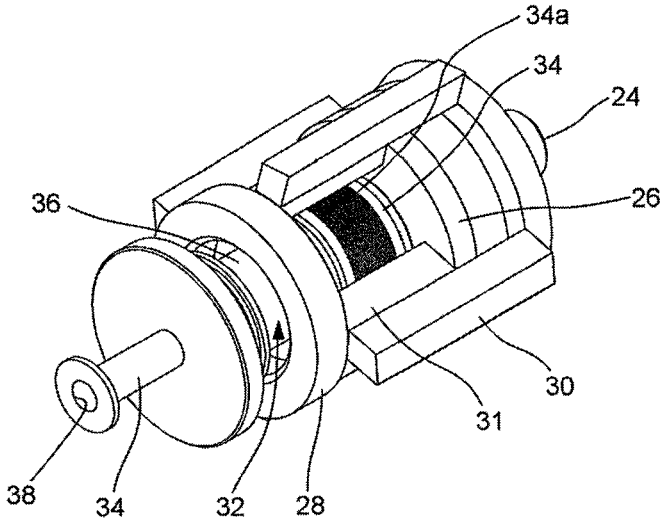
FIG. 2 is a perspective view illustrating a major part of the media-agitation type pulverizer illustrated in FIG. 1.
Figure 3:
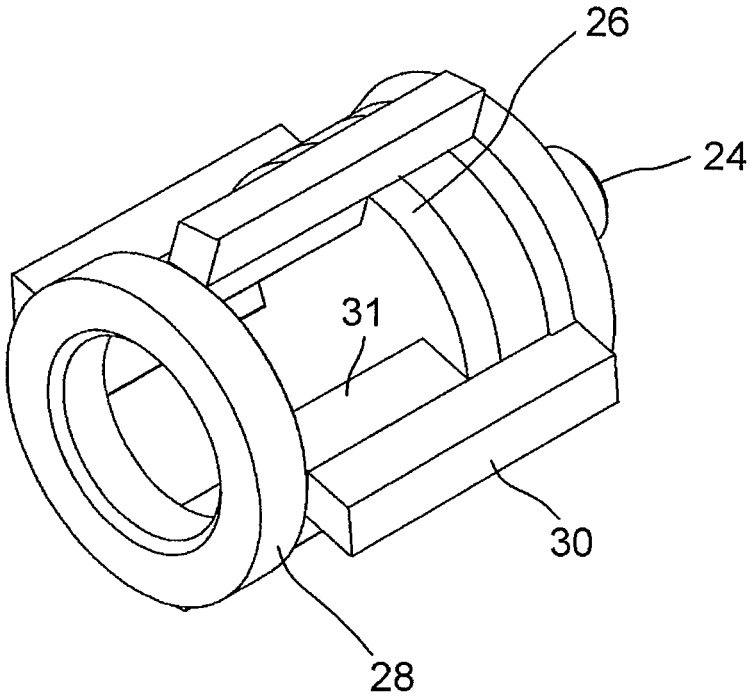
FIG. 3 is a perspective view illustrating only an agitating means in the major part illustrated in FIG. 2.

With reference to the accompanying drawings, a media-agitation type pulverizer of the present invention will now be described. FIG. 1 illustrates a media-agitation type pulverizer 10 according to one embodiment of the present invention. The media-agitation type pulverizer 10 has a grinding chamber 20 which comprises: a cylindrical barrel 12; an end plate 14 fixed to one end of the barrel 12; and a frame (not illustrated) fixed to the other end of the barrel 12 through a material-supply-passage flange 16. The grinding chamber 20 is constructed to form a hermetically-sealed grinding space C1 thereinside. As is well known, in the media-agitation type pulverizer, grinding media in the form of beads (not illustrated) are contained in the grinding space C1.

The barrel 12 has an internal space in which an agitating means 22 is rotatably disposed. The agitating means 22 is disposed in coaxial relation to the barrel 12 and thus the grinding chamber 20. The agitating means 22 comprises: a circular plate-shaped hub member 26 fixed to one end of a rotary drive shaft 24 located inside the grinding chamber 20, wherein the rotary drive shaft 24 extends from the side of one end of the grinding chamber 20 into the grinding chamber; an annular end plate 28 disposed in spaced-apart relation to the hub member 26 in an axial direction of the rotary drive shaft 24; a plurality of agitating members 30 fixed between the hub member 26 and the end plate 28 at circumferential intervals, in a posture where each of them protrudes radially outwardly with respect to respective outer peripheries of the hub member 26 and the end plate 28; and a plurality of grinding media scraping-out members 31 for scraping out the grinding media residing inside the agitating means 22 toward an outside of the agitating means 22, wherein the grinding media scraping-out members 31 are fixed between the hub member 26 and the end plate 28 at circumferential intervals, in a posture where each of them extends radially inwardly with respect to the outer peripheries of the hub member and the end plate.

Figure 5:
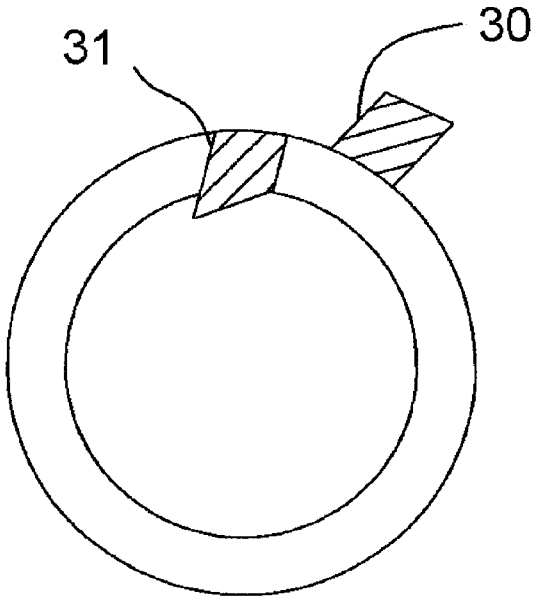
FIG. 5 is a view corresponding to FIG. 4, which illustrates one modification of a structure of an agitating member and a grinding media scraping-out member.
Figure 6:
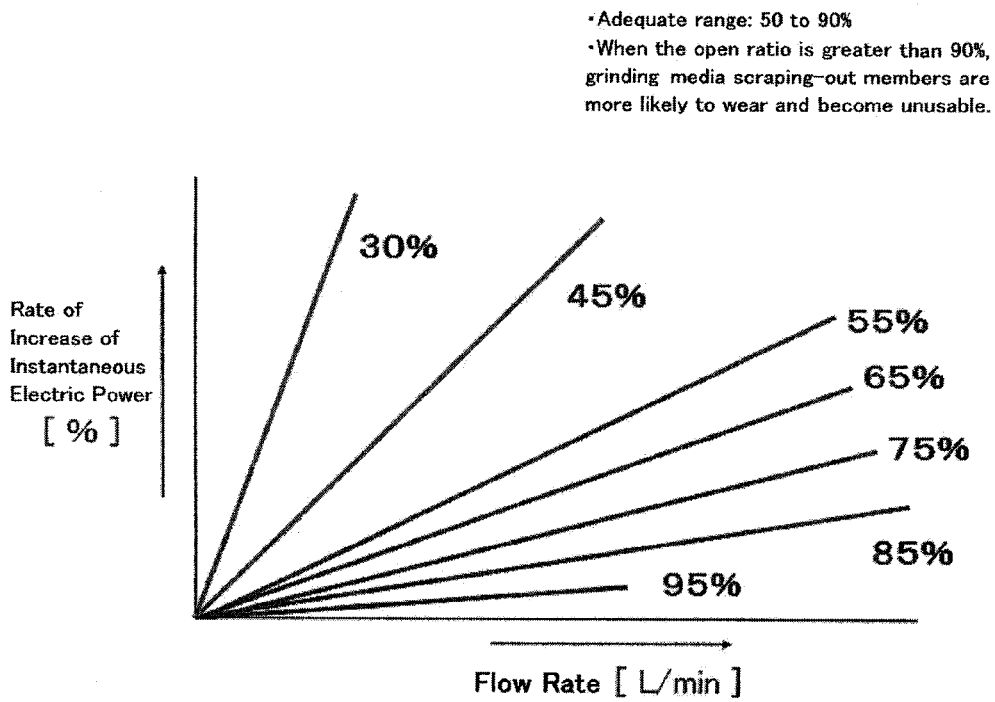
FIG. 6 is a graph presenting a result of a performance test for a media-agitation type pulverizer according to one embodiment of the present invention and a media-agitation type pulverizer as a comparative example.

An open region as a part of an outer periphery of the agitating means 22 other than thicknesses of the agitating members 30 and the grinding media scraping-out members 31 is formed as a grinding media circulation opening 22*a* for circulating the grinding media from the inside to the outside of the agitating means, wherein an open ratio as an area ratio of the grinding media circulation opening 22*a* to a circumferential plane between opposing surfaces of the hub member 26 and the end plate 28 of the agitating means 22 is set to 50 to 90%, particularly preferably 70 to 90%. This embodiment discloses an example in which each of a plurality of sets of the agitating member 30 and the grinding media scraping-out member 31 are formed in an integral structure. Alternatively, they may be separate members, as illustrated in FIG. 5. However, the agitating means having the integral structure makes it possible to set the open ratio to a larger value. If the open ratio goes beyond the above range, the thicknesses of the agitating members 30 and the grinding media scraping-out members 31 relatively decrease. This is likely to cause deterioration in strength and thus structural brittleness.

The rotary drive shaft 24 extends to penetrate through the frame in the axial direction and then allow the other end thereof to be connected to a drive source via a non-illustrated well-known drive mechanism, so that it can be rotationally driven in a given direction. The rotary drive shaft 24 is provided with a non-illustrated shaft sealing element (mechanical seal or the like). The material-supply-passage flange 16 is formed with a material supply passage 16*a* for supplying a slurry material into the grinding space C1. The material supply passage 16*a* has a material supply port 16*b* for actually introducing the material into the grinding space C1 therethrough, wherein the material supply port 16*b* is preferably positioned on the side of a back surface of the agitating means 22, i.e., a back surface of the hub member 26. As is well known, in the media-agitation type pulverizer, grinding media in the form of beads (not illustrated) are contained in the grinding space C1.

The agitating means 22 has an internal space in which a grinding media separating means 32 is provided such that it is disposed in coaxial relation to the rotary drive shaft 24 for the agitating means 22 to separate the grinding media dispersed in the slurry material, from the material. The internal space of the agitating means 22, particularly, a space between the grinding media separating means 32 and a cylindrical wall 22*a* of the agitating means 22, will hereinafter be referred to as a media separating space C2. As the grinding media separating means 32, it is possible to use a screen type (see FIG. 1) or a centrifugal blade type (not illustrated). In particular, a screen type grinding media separating means is effectively usable in the present invention.

The screen type grinding media separating means 32 comprises: a separating means body 34 disposed inside the agitating means 22, and provided with a screen separator 34*a* therearound; and a support member 36 supporting the separating means body. The grinding media separating means 32 is fixed to the side of the other end of the grinding chamber, i.e., to the end plate 14, and the separating means body 34 is inserted into the internal space of the agitating means from the side of the other end. That is, the support member 36 has a base end fixed to the end plate 14, and extends from the base end into the internal space of the agitating means 22 to have a distal end to which the separating means body 34 is fixed.

Preferably, the separating means body 34 is completely received in the internal space of the agitating means 22. More preferably, this separating means body has the overall length which is 20 to 80% of the overall length of the internal space of the agitating means 22. Preferably, the separating means body 34 is disposed in the internal space of the agitating means 22 at a position close to the hub member 26.

Preferably, the separating means body 34 has an outer diameter which is 80% or more of a diameter of a circle connecting respective inner edges of the grinding media scraping-out members 31, and a gap between the diameter of the circle connecting the inner edges of the grinding media scraping-out members and the outer diameter of the separating means body is three times or more greater than a diameter of each of the grinding media. This is intended to make an action of the grinding media scraping-out members 31 more effective.

Preferably, the support member 36 has an outer diameter which is 50% or more of an inner diameter of the annular end plate 28 of the agitating means 22, and a gap between the inner diameter of the agitating means and the outer diameter of the support member is three times or more greater than the diameter of each of the grinding media. In this case, the outer diameter of the support member 36 is equal to an outer diameter of the separating means body 34 at a maximum, and is preferably less than the outer diameter of the separating means body 34. This is intended to allow a mixture of the material slurry and the grinding media to easily flow into the separating space C2.

A ratio of a radial length of an operating surface of each of the grinding media scraping-out members 31 to a radial length of an operating surface of a corresponding one of the agitating members 30 is 3:7 to 7:3, preferably, 4:6 to 6:4, particularly in the case where the two members are integrated into a single piece. Although the operating surface of the grinding media scraping-out member 31 may extend from an outer peripheral edge of the annular end plate 28 of the agitating means 22 and then protrude inwardly from an inner peripheral edge of the annular end plate 28, as illustrated in the drawing, it is preferable to terminate at the inner peripheral edge.

Figure 4:
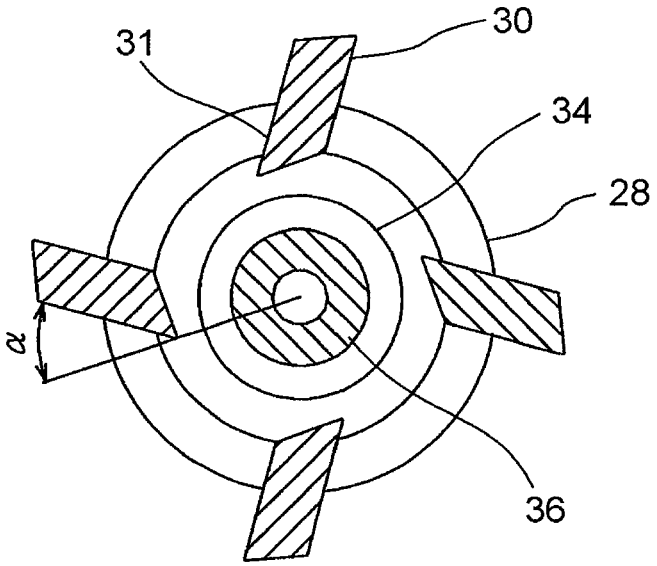
FIG. 4 is a transverse sectional view of the media-agitation type pulverizer illustrated in FIG. 1, wherein the cross-section is taken to appropriately show a configuration of a member or component, and a barrel is omitted.

In this embodiment, an angle $\alpha$ defined between the operating surface of each of the grinding media scraping-out members and a radial axis of the agitating means 22 is 0 to 45 degrees, preferably, 10 to 40 degrees. Preferably, an scraping-out end of each of the grinding media scraping-out members 31 is configured as an acute-angled surface coming away from a surface of the separating means body 34 toward a rotation-directional downstream side thereof, as illustrated in FIG. 4.

The grinding media separating means 32 is provided with a material discharge passage 38 extending from an outside of die grinding chamber 12 to an inside of the separating means body 34, as illustrated in FIG. 1. An end of the material discharge passage 38 opened to the inside of the separating means body 34 is formed as a material discharge port 40.

Upon start of operation, the agitating means 22 is rotationally driven while slurry containing target particles to be pulverized is introduced as a material from the material supply passage 16*a*. The slurry introduced into the grinding space C1 is agitated to undergo rotational motion within the grinding space C1, together with the grinding media. According to the rotational motion of the grinding media the particles in the material slurry are pulverized or dispersed. Together with the grinding media, the material slurry enters mainly from an opening of an end of the agitating means 22 into the hollow internal space, i.e., the separating space C2, of the agitating means. Then, according to the grinding media separating means 32, the grinding media are separated from the material slurry, and only the material slurry is discharged outside the grinding chamber via the material discharge passage 38.

During the above operation, the grinding media which primarily tend to adhere onto the screen separator 34*a* of the separating means body 34 of the grinding media separating means 32 are scraped out by the grinding media scraping-out members 31 of the agitating means 22 being rotated, and led from the inside to the outside of the agitating means 22 via the grinding media circulation opening 22*a*, whereafter the grinding media is re-used to pulverize or disperse target particles in material slurry.

An instantaneous electric power was measured using the media-agitation type pulverizer 10 illustrated in FIGS. 1 to 4, under the condition that: glycerin (viscosity: 800 mP·S (25° C.), 200 mP·S (45° C.)) was used as slurry; a filling rate of the grinding media in the grinding space was fixed to 80%; and the open ratio of the grinding media circulation opening 22*a* was sequentially set to 30%, 45%, 55%, 65%, 75%, 85% and 95%, while a supply flow rate of the slurry was continuously changed. A result of the measurement was as presented in the graph of FIG. 5. When the open ratio was set to 95%, due to decrease in thickness of the agitating members and the grinding media scraping-out member, strength thereof deteriorates, so that the members were broken during the measurement. Thus, it was evaluated as unusable. As is evident from this graph, the present invention has advantageous effects.

LIST OF REFERENCE SIGNS

10: media-agitation type pulverizer
12: barrel
14: end plate
16: material-supply-passage flange
16*a*: material supply passage
16*b*: material discharge passage
18: frame
20: grinding chamber
22: agitating means
22*a*: grinding media circulation opening
24: rotary drive shaft
25: shaft scaling element
26: circular plate-shaped hub member
28: annular end plate
30: agitating member
31: grinding media scraping-out member
32: grinding media separating means
34: separating means body
34*a*: screen separator
36: support member

The invention claimed is:

1. A media-agitation pulverizer comprising:
a cylindrical grinding chamber;
a cylindrical agitating means disposed inside the grinding chamber rotatably in coaxial relation thereto;
a grinding media separating means disposed inside the agitating means in coaxial relation thereto;
a grinding space disposed between an outer periphery of the agitating means and an inner periphery of the grinding chamber;
grinding media contained in the grinding space;
a material supply passage for supplying a slurry material into the grinding chamber; and
a material discharge passage for discharging a dispersed and/or pulverized material to an outside of the grinding chamber,
wherein the agitating means comprises:
a circular plate-shaped hub member fixed to an end of a rotary drive shaft located inside the grinding chamber, the rotary drive shaft extending from the side of one end of the grinding chamber into the inside of the grinding chamber;
an annular end plate disposed in spaced-apart relation to the hub member in an axial direction of the rotary drive shaft;
a plurality of agitating members fixed between the hub member and the end plate at circumferential intervals, in a posture where each of them protrudes radially outwardly with respect to respective outer peripheries of the hub member and the end plate; and
a plurality of grinding media scraping-out members for scraping out the grinding media residing inside the agitating means toward an outside of the agitating means, the grinding media scraping-out members being fixed between the hub member and the end plate at circumferential intervals, in a posture where each of them extends radially inwardly with respect to the outer peripheries of the hub member and the end plate, and
wherein an open region as a part of an outer periphery of the agitating means other than thicknesses of the agitating members and the grinding media scraping-out members is formed as a grinding media circulation opening for circulating the grinding media from the inside to the outside of the agitating means, and
wherein an open ratio as an area ratio of the grinding media circulation opening to a circumferential plane between opposing surfaces of the hub member and the end plate of the agitating means is 50 to 90%, and
wherein the grinding media separating means comprises a separating means body and a support member supporting the separating means body, and
wherein the separating means body has an outer diameter which is 80% or more of a diameter of a circle connecting respective inner edges of the grinding media scraping-out members, and a gap between the diameter of the circle connecting the inner edges of the grinding media scraping-out members and the outer diameter of the separating means body is three times or more greater than a diameter of each of the grinding media, and
wherein the separating means body is completely received in an internal space of the agitating means.

2. The media-agitation pulverizer as recited in claim 1, wherein the open ratio of the grinding media circulation opening to the circumferential plane between opposing surfaces of the hub member and the end plate of the agitating means is 70 to 90%.

3. The media-agitation pulverizer as recited in claim 1, wherein a ratio of a radial length of an operating surface of each of the grinding media scraping-out members to a radial length of an operating surface of the agitating means is 3:7 to 7:3.

4. The media-agitation pulverizer as recited in claim 3, wherein the ratio of the radial length of the operating surface of each of the grinding media scraping-out members to the radial length of the operating surface of the agitating means is 4:6 to 6:4.

5. The media-agitation pulverizer as recited in claim 1, wherein an angle defined between an operating surface of each of the grinding media scraping-out members and a radial axis of the agitating means is 0 to 45 degrees.

6. The media-agitation pulverizer as recited in claim 5, wherein an angle defined between an operating surface of each of the grinding media scraping-out members and a radial axis of the agitating means is 10 to 40 degrees.

7. The media-agitation pulverizer as recited in claim 1, wherein each of a plurality of sets of the agitating member and the grinding media scraping-out member are integrated into a single piece.

8. The media-agitation pulverizer as recited in claim 1, wherein the grinding media separating means is fixed to the side of the other end of the grinding chamber, and wherein the separating means body is inserted into an internal space of the agitating means from the side of the other end.

9. The media-agitation pulverizer as recited in claim 8, wherein the separating means body has an overall length which is 20 to 80% of an overall length of the internal space of the agitating means.

10. The media-agitation pulverizer as recited in claim wherein the grinding media separating means is a screen type pulverizing media separating means.

11. The media-agitation pulverizer as recited in claim 1, wherein the support member has an outer diameter which is 50% or more of an inner diameter of the agitating means, and a gap between the inner diameter of the agitating means and the outer diameter of the support member is three times or more greater than the diameter of each of the grinding media, with respect to an inner diameter of the end plate of the agitating means.

* * * * *